United States Patent [19]

Seykora

[11] 4,357,765

[45] Nov. 9, 1982

[54] APPARATUS FOR SECURING OVERLAPPING PORTIONS OF TWO DIGGER TOOTH MEMBERS TOGETHER

[75] Inventor: James E. Seykora, Hibbing, Minn.

[73] Assignee: United States Steel Corporation, Pittsburgh, Pa.

[21] Appl. No.: 281,442

[22] Filed: Jul. 8, 1981

Related U.S. Application Data

[63] Continuation of Ser. No. 133,166, Mar. 24, 1980, abandoned.

[51] Int. Cl.[3] ..... E02F 9/28

[52] U.S. Cl. ..... 37/142 R

[58] Field of Search ..... 37/141 R, 141 T, 142 R, 37/142 A; 172/772; 403/409, 315, 316, 374; 299/91, 92; 175/411, 375

[56] References Cited

U.S. PATENT DOCUMENTS

| | | | |
|---|---|---|---|
| 327,052 | 9/1885 | Allen | 37/142 R |
| 1,992,591 | 2/1935 | Whisler | 37/142 R |
| 2,369,285 | 2/1945 | Daniels et al. | 37/142 R |
| 3,160,967 | 12/1964 | Nichols | 37/141 R |
| 3,440,745 | 4/1969 | Palm | 37/142 R |
| 3,455,040 | 7/1969 | Ratkowski | 37/142 R |
| 3,894,349 | 7/1975 | Moreau | 37/142 A |

*Primary Examiner*—E. H. Eickholt

*Attorney, Agent, or Firm*—William F. Riesmeyer, III

[57] ABSTRACT

An improvement is provided in apparatus for securing overlapped portions of two members together. In addition to a wedge conventionally inserted in holes generally axially aligned in the overlapped portions, a locking bar is provided for insertion longitudinally in the holes and has a notch with opposed faces for tightly engaging the outer surfaces of one of the members which is subject to less flexing movement than the other. The wedge and bar are secured together after insertion to prevent loosening of the wedge in service.

3 Claims, 1 Drawing Figure

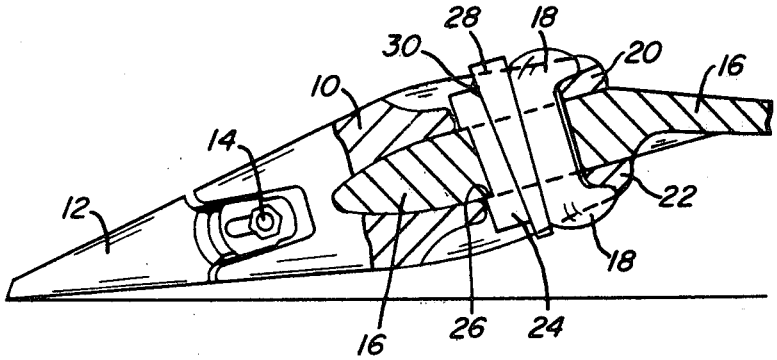
28
18
30
20
16
10
14
12
22
18
16
26
24

APPARATUS FOR SECURING OVERLAPPING PORTIONS OF TWO DIGGER TOOTH MEMBERS TOGETHER

This is a continuation of application Ser. No. 133,166, filed Mar. 24, 1980, now abandoned.

BACKGROUND OF THE INVENTION

This invention relates to apparatus for securing two members together, and particularly for securing a tooth adapter to an excavating dipper.

U.S. Pat. No. 1,992,591 Whisler, shows a C-clamp and wedge typically used to secure a tooth adapter to the lip of an excavating dipper. The dippers are often used in open pit mining of ore. Sometimes the wedge works loose in service allowing the adapter and teeth to fall off. They then get mixed in with the ore and cause serious damage to crushing apparatus used to treat the ore after the mining operation.

Numerous attempts have been made to prevent loss of the adapters and teeth on excavating dippers. Examples are shown in U.S. Pat. Nos. 3,160,967 Nichols, 3,440,745 Palm and 3,455,040 Ratkowski.

None of these attempts to solve the problem have been completely successful. In addition, welding the wedge to the C-clamp shown in the Whisler patent has been tried, but this has also not solved the problem. It is believed that the reason for lack of success in solving the problem in the past has been due to the fact that it was not recognized that the digging member and base flex to substantially different degrees in service. In addition, attempts to secure the wedge have been inadequate.

It is therefore the primary object of this invention to provide apparatus for firmly securing two members together where one of the members is subject to more flexing movement than the other.

SUMMARY OF THE INVENTION

The improved apparatus of this invention includes a locking bar for insertion longitudinally in generally mateably aligned holes in overlapped portions of two members to be attached together. The bar has a longitudinal face adjoining a wedge conventionally used for securing the two members on one side and a sidewall of the holes on the other. A notch is located on the longitudinal side of the bar adjoining the sidewall of the holes. Opposing faces of the notch are spaced so as to tightly engage outer surfaces of one of the members which is subject to less flexing movement than the other. The sidewalls of the holes in the members are to be slightly offset adjacent opposing faces of the notch of the locking bar so as to permit tight engagement of the bar with the outer surfaces of the member subject to less flexing. Means is also provided to secure the locking bar and wedge together after insertion in the holes so as to prevent loosening of the wedge in service. The invention is particularly applicable to securing toothed adaptors to excavating dippers in order to prevent loss of the adaptor in service.

BRIEF DESCRIPTION OF THE DRAWINGS

The sole FIGURE is a cut-away side elevation view of an excavating dipper and tooth adapter secured by the apparatus of this invention.

DESCRIPTION OF THE PREFERRED EMBODIMENT

Although not limited thereto, the apparatus of this invention will be described as applied to an excavator dipper and tooth adaptor as shown in U.S. Pat. No. 1,992,591 Whisler, the specification of which is incorporated herein. While the adaptor shown is an older type the invention is equally applicable to ones more recently developed. Referring to FIG. 1, an adapter 10 has a tooth which is shown at 12, attached to the adapter by bolt 14. Together the adapter and tooth are attached to a shovel or dipper lip 16 (only partially shown). A conventional C-clamp 18 as disclosed in the Whisler patent engages the outer faces of the adapter arms 20, 22. According to this invention a bar 24 with notch 26 is inserted partially in the cooperating openings in the adapter and digger lip. Wedge pin 28 is also inserted in the opening and then driven so as to seat bar 24 with the notch tightly engaging the outer faces of the projecting portion of the digger lip. Then, the wedge is welded as shown at 30 to secure it to the bar. Thus, the bar which is seated firmly on the digger lip holds the wedge secure and thus prevents it from loosening in service.

I claim:

1. Apparatus for securing a tooth adaptor to the lip of an excavator, said adaptor having arms for fitting over respective top and bottom surfaces of the lip of said excavator, each of said arms and lip having a hole therethrough, said holes being generally mateably aligned, said apparatus comprising:

a C-clamp member for mounting in said holes, the parallel legs of the C adapted to tightly engage outer surfaces of the respective arms of said adaptor so as to clamp said arms against the excavator lip, a locking bar adapted for insertion in said holes and having a notch in one longitudinal side thereof for abutting a sidewall of the excavator lip, opposed end faces of said notch being adapted to tightly engage the outer surface of the lip of said excavator, the holes in said lip and arms being offset slightly so as to permit said engagement thereof by said notch, an incompressible metal wedge for insertion centrally between said C-clamp member and locking bar for securing said adaptor to the excavator lip, whereby, loosening of the wedge by flexure of the arms of said adaptor in service is prevented.

2. The apparatus of claim 1 further comprising means for securing the wedge to said locking bar after when said bar and wedge are properly seated in position in said holes.

3. The apparatus of claim 2 wherein said means for securing the bar to the wedge includes at least one weld joining part of adjacent faces thereof.

* * * * *